US005265512A

United States Patent [19]

Kubicki et al.

[11] Patent Number: 5,265,512

[45] Date of Patent: Nov. 30, 1993

[54] APPARATUS AND METHOD FOR TUNING AND INTONATING THE STRINGS OF A BASS OR TREBLE GUITAR

[75] Inventors: Philip Kubicki; Ronald O. Browne, both of Santa Barbara, Calif.

[73] Assignee: Collins Kubicki, Inc., Santa Barbara, Calif.

[21] Appl. No.: 959,053

[22] Filed: Oct. 9, 1992

Related U.S. Application Data

[62] Division of Ser. No. 664,549, Mar. 4, 1991, Pat. No. 5,171,927.

[51] Int. Cl.[5] ..... G10D 3/04

[52] U.S. Cl. ..... 84/298

[58] Field of Search ..... 84/297 R, 298, 306, 84/307

[56] References Cited

U.S. PATENT DOCUMENTS 4,681,010 7/1987 Wilkinson ..... 84/297 R 5,171,927 12/1992 Kubicki et al. ..... 84/297 R

*Primary Examiner*—Michael L. Gellner

*Assistant Examiner*—P. Stanzione

*Attorney, Agent, or Firm*—Richard L. Gausewitz

[57] ABSTRACT

An adjustable saddle mechanism for a guitar string comprises upper and lower saddle elements. A compound lever system is provided to lock the saddle elements in any one of an infinite number of positions.

12 Claims, 3 Drawing Sheets

APPARATUS AND METHOD FOR TUNING AND INTONATING THE STRINGS OF A BASS OR TREBLE GUITAR

This is a division of application Ser. No. 665,549, filed Mar. 4, 1991, for Apparatus and Method for Turning and Intonating the Strings of a Bass or Treble Guitar, U.S. Pat. No. 5,171,927.

BACKGROUND OF THE INVENTION

It has for many decades been known to use toothed wheels to tune the strings of musical instruments. Two of the most recent mechanisms of this type involve headless guitars or headless bass guitars. These are shown by U.S. Pat. Nos. 4,693,160 and 4,712,463.

U.S. Pat. No. 4,693,160 teaches a mechanism in which there is constant meshing between worm teeth and the teeth of a worm wheel. No means is provided for permitting direct manual operation of the worm wheel—without using the worm—so as to rapidly obtain gross or coarse adjustments.

U.S. Pat. No. 4,712,463 provides a mechanism which permits direct manual operation of a toothed wheel that is not a worm wheel. This is done by providing an element in releasable relationship on an intermediate member between the toothed wheel and a fine adjustment screw. Although this mechanism is on the market, and works well, it has disadvantages one of which is that the amount of fine tuning which can be achieved is not unlimited for any particular coarsetuning setting. Thus, it can occur that the mechanism runs out of travel—during fine tuning—after a certain coarse adjustment has been made; then, it is necessary to release the mechanism and repeat the coarse and fine tuning operations.

It has also, for many decades, been conventional in electric guitars and basses to provide bridges that can be adjusted both vertically and longitudinally of the string, so as to (a) change string height, and (b) achieve correct intonation. Many types of constructions have been patented for these purposes. However, no mechanism known to applicants has great versatility and speed of adjustment plus an extremely low energy requirement for effective, accurate locking and unlocking (clamping and unclamping) of the bridge mechanism.

SUMMARY OF THE INVENTION

It has now been discovered that there can be direct contact between a worm and worm wheel while still permitting release of the mechanism so that the worm wheel may be directly manually coarse adjusted. The amount of fine tuning which may be effected is unlimited at any particular coarse-tuning setting. Thus, it is never necessary to repeatedly perform coarse and fine tuning operations in order to obtain a particular desired pitch.

In a preferred embodiment, the mechanism comprises an elongate worm that is pivotally mounted in a particular manner for pivoting about an axis that is parallel to the shaft of the worm wheel. The worm is lightly biased to such a pivoted position that the worm wheel is engaged, and the relationships are such that the string tension increases the "locking" between the worm and the worm wheel. ("Locking", and "locked", as here used, mean that the worm prevents the worm wheel from turning unless the worm itself is rotated about its own axis.) When it is desired to make a fine adjustment, the worm is turned, through any number of revolutions, about its own axis. When it is desired to replace a string, the worm is merely pivoted away from the worm wheel so as to release the latter and thus the string.

In accordance with one important aspect of the present invention, the worm and worm wheel are so constructed and associated as to cooperate with each other in the manner of both a worm gear and a pawl-and-ratchet mechanism.

In accordance with another aspect of the invention, the worm is not necessarily a "gear" in the sense that special gear-cutting mechanisms are required to manufacture the worm. Instead, the worm can be a standard screw thread, like that on a conventional bolt, so as to reduce costs.

A mechanism is provided to prevent accidental pivoting of the worm away from the worm wheel, without at any time interfering with the fine tuning operation of the worm.

A brake mechanism is provided to prevent free spinning of the worm wheel when the worm is pivoted to a release position. Such free spinning, which would be caused by string tension, could create backlash and other undesired results.

The method of the invention comprises causing a worm to be pivotable into and out of engagement with a worm wheel in a stringed musical instrument such as an electric guitar or bass guitar. The method further comprises coarse tuning such guitar when the worm is not locked to the worm wheel, and fine tuning the guitar when the worm is locked thereto. The method further comprises so relating the worm with the worm wheel that string tension causes the worm to tend to remain locked with the worm wheel, as distinguished from tending to shift to a released position. The method further comprises creating a pawl-and-ratchet action between worm and worm wheel during coarse tuning.

In accordance with another major aspect of the present invention, a longitudinally and vertically adjustable string saddle is provided that permits intonation to be effected rapidly and easily, with very little energy being required in order to lock the saddle in any desired position. The mechanism comprises vertical string-height-adjustment screws, in combination with a tilt screw, creating a compound lever action to lock the mechanism in any of a vast number of positions adapted to achieve the desired intonation and string height.

DETAILED DESCRIPTION OF THE PREFERRED EMBODIMENT

In the following portion of the present specification and claims, the word "guitar" means either a standard (treble) guitar or a bass guitar, or a similar musical instrument.

Figure 1:
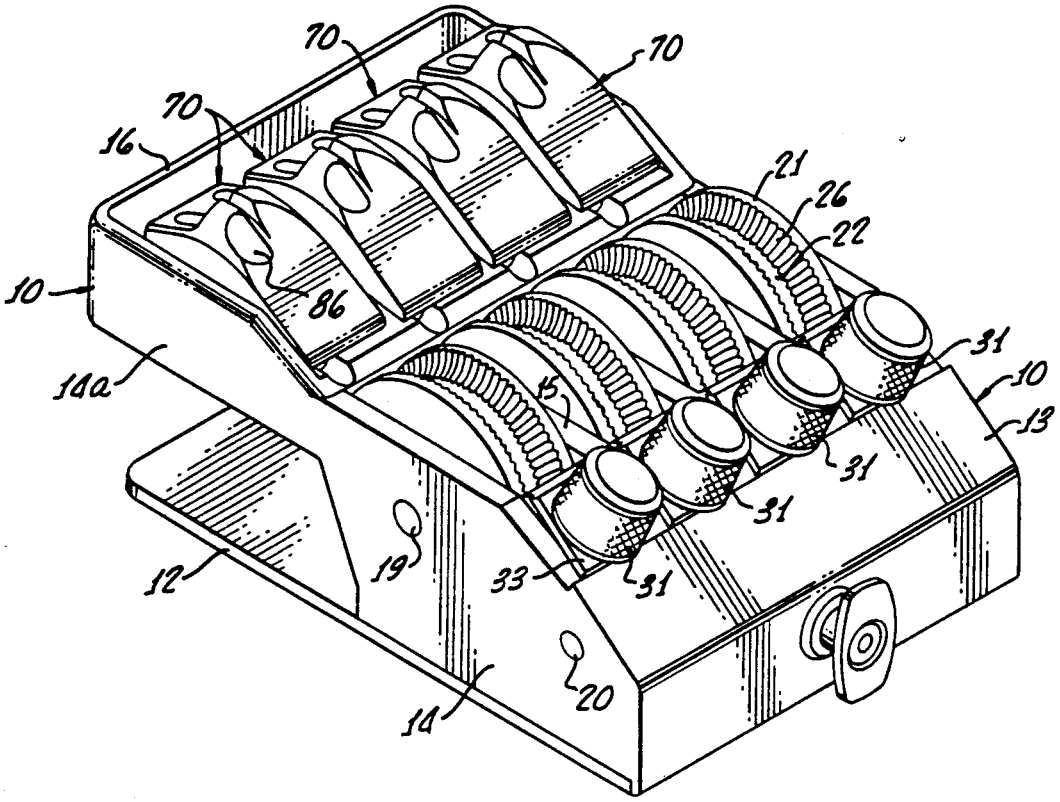
FIG. 1 is an isometric view of the tuning and intonation mechanism.

There is hereby incorporated by reference into the present application FIG. 1 of U.S. Pat. No. 4,712,463. This shows a headless guitar which is identical to the present one except for the constructions of the tuner and of the saddles or bridges.

The invention is shown and described relative to a four-string bass, but it could equally well be on a five-string bass or (as above indicated) on a treble guitar.

The tuning and intonation mechanisms for each string are identical to those for each other string.

The present system may be made in modular components, but is preferably—in order to minimize the number of parts—incorporated into a single base 10 which is mounted on the body 11 of the guitar. The base 10 comprises a single metal casting having an open bottom, such open bottom being closed by a bottom plate 12 that is secured by screws to the periphery of the outer portion of the casting.

The outer portion of base 10 has a back wall 13, and also has parallel sidewalls 14 that extend for substantially the full height of the indicated casting. Provided in parallel relationship to sidewalls 14 and to each other are three spaced-apart divider walls 15. These walls 15 and the sidewalls 14 define four generally rectangular chambers or recesses each of which is adapted to receive one of the worm gear mechanisms described below. Such worm gear mechanisms are, at the same time, pawl and ratchet mechanisms.

At its inner or forward portion, the casting is spaced a substantial distance above a forwardly-extending section of bottom plate 12. This inner or forward portion of the casting has its own bottom, also part of the casting, which bottom is indicated subsequently relative to a description of adjustable saddle elements that are mounted thereon. The inner or forward portion has sidewalls **14*a* that form extensions of the upper regions of the sidewalls 14, and also has a forward or inner wall 16**.

Figure 2:
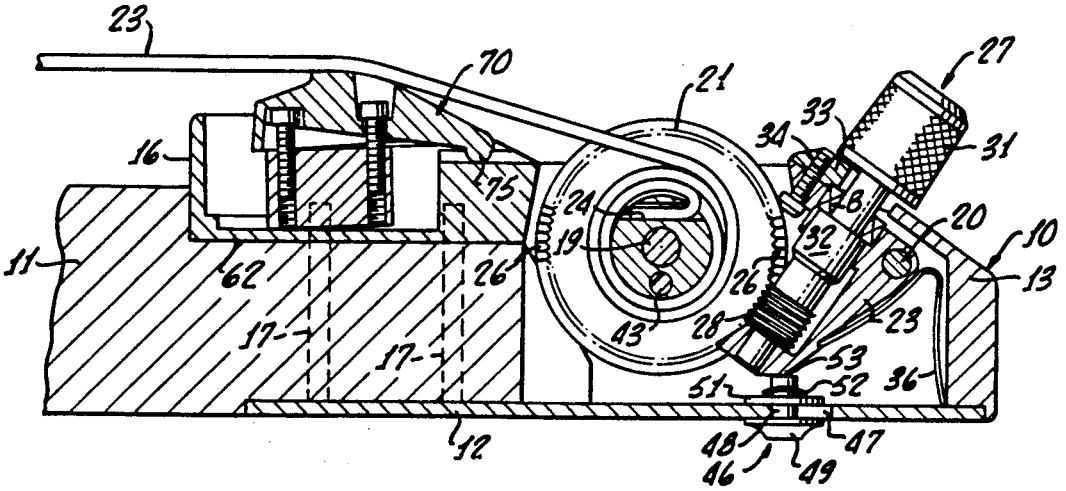
FIG. 2 is a vertical sectional view of the present worm-gear tuner, showing a worm as lightly spring-pressed into locking engagement with a worm wheel so that any amount of fine tuning may be effected.

To mount the combination tuning and intonation mechanism, a specially formed region of the guitar body 11 is caused to fit snugly between the protruding portion of bottom plate 12 and the forward or inner portion of the casting, as shown in FIG. 2. Then, screws 17 are extended through the bottom plate and into the casting as illustrated.

The Combination Worm Gear and Pawl-and-Ratchet Mechanism

Forward and rear shafts 19 and 20 are extended through walls 14,15 perpendicularly thereto, and are suitably held against shifting relative to the base 10. As shown in FIG. 2, the rear shaft 20 is at a slightly lower elevation than is the forward shaft 19. Furthermore, the rear shaft 20 is quite close to back wall 13.

A combination worm wheel and ratchet wheel (called the worm-and-ratchet wheel) 21 is mounted on the forward shaft 19 in each of the above-indicated chambers or recesses between the walls 14,15. Each wheel 21 is a free sliding fit relative to the surface of shaft 19, so that each wheel 21 can rotate freely on shaft 19 unless restrained as described below. The width of each wheel 2 is less than the distance between adjacent walls 14,15 or 15,15.

Figure 6:
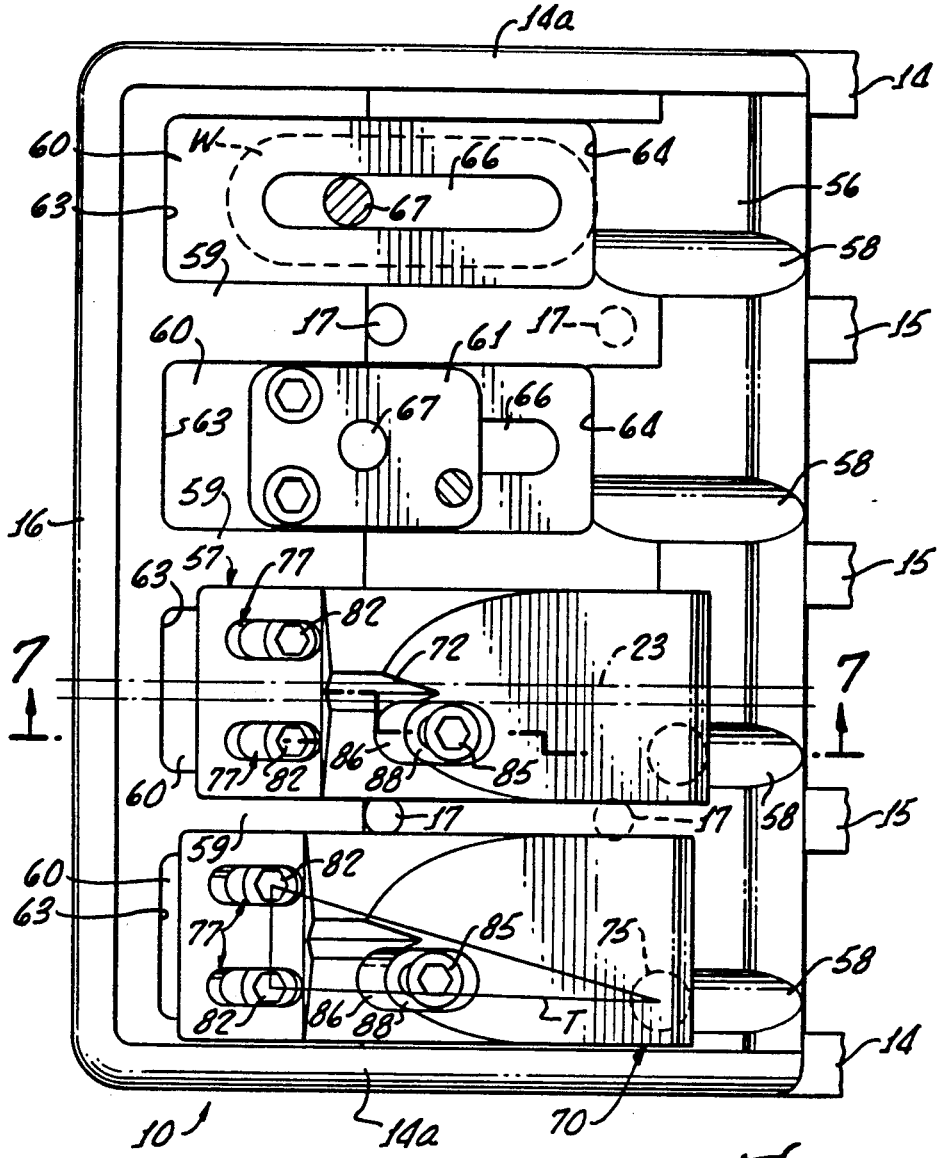
FIG. 6 is a top plan view of saddle mechanisms incorporating the present invention, portions of some saddle mechanisms being removed.
Figure 7:
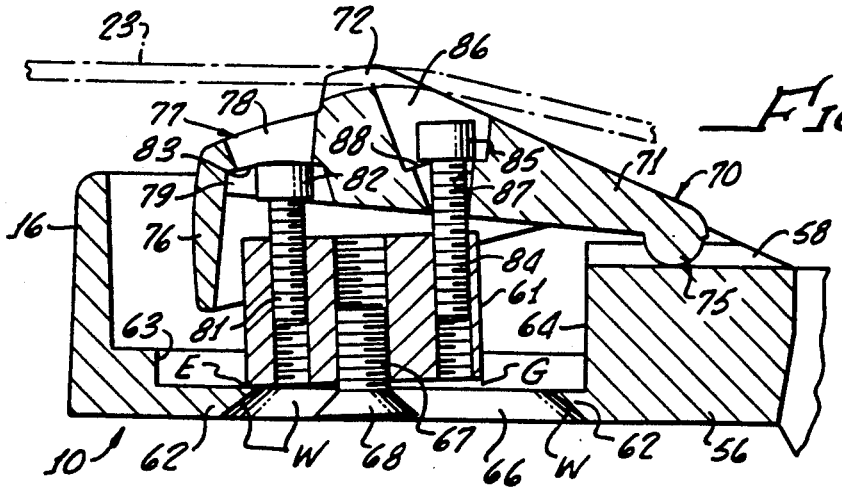
FIG. 7 is an enlarged vertical sectional view of one such saddle mechanism.

Formed in the central plane of each worm-and-ratchet wheel 21 is a deep groove 22 adapted to receive one of the guitar strings, one such string 23 being shown by FIGS. 2, 6 and 7. For large diameter strings, the coils are on top of each other in the manner of a volute. For small diameter strings, some of the coils of string can be side by side. Each string is started by having its end inserted through a string bore 24 (FIG. 2), the string then being bent sharply as it comes out of the bore as shown in FIG. 2. Each bore 24 is drilled through a wheel 21 at the bottom of groove 22, and in offset relationship from the central wheel hole through which shaft 19 extends.

Adjacent the outer region of each string groove 22, the opposed edges of each wheel 21 are bevelled. Furthermore, the bevelled edges are provided with worm wheel teeth 26 about the complete circumference of the wheel 21, there being two toothed and bevelled regions opposite each other—on opposite sides of the groove—in each wheel 21.

The worm wheel teeth 26 are formed in the manner of female screw threads, by a tap in a milling machine. The screw threads on opposite sides of groove 22 are made simultaneously and are "continuous", being in the same relationship they would be in if no groove 22 were present.

As a specific example of the preferred embodiment, each wheel 21 has an outer diameter of 1.62 inches. The teeth 26 are standard ⅜ inch-24 left-hand female- screw thread teeth. The material of the wheel 21 is preferably aluminum (for weight saving) or brass. Preferably, the aluminum is coated, at least at the teeth, with a lubricant in the form of Teflon-impregnated anodizing.

Mounted tangentially in cooperating relationship with the worm-and-ratchet wheel 21 is a combination worm element and pawl element 27 (called a worm-and-pawl element). This is a cylindrical shaft having worm teeth 28 thereon that cooperate with the worm wheel teeth 26 in worm and worm wheel relationship. Preferably, the worm teeth 28 are a male screw thread that mates with the female screw thread that is tapped as described above.

In the specific example of the preferred embodiment, the male screw thread is a ⅜-24 3A left-hand standard screw thread, with a pitch diameter in the range of 0.3479 inch to 0.3450 inch. The material of the shaft is preferably 303 stainless steel. The blank size of the shaft cylinder, before creation of the worm teeth 28 (the screw thread), is 0.350 inch outer diameter.

The worm-and-pawl element 27, that is to say the shaft 27, is mounted on a frame 29 in such manner, by ball bearing and other means, that the shaft may be rotated by a thumb knob 31 without moving longitudinally. Frame 29 is pivotally mounted on the above-indicated rear shaft 20, there being a free sliding connection between the frame and the shaft so that the shaft need not turn when the frame pivots thereon.

In the preferred embodiment, frame 29 has an apertured lower arm portion through which rotatably extends a necked-down cylindrical end of the shaft 27. A cylindrical boss 32 is formed integrally on shaft 27 in spaced relationship above the worm teeth 28. Above the cylindrical boss 32, the shaft is of a reduced diameter to accept the inner race of a ball bearing B, the inner race abutting against the upper surface of boss 32. Frame 29 has a bored upper arm portion into which the ball bearing B fits. The bore in such upper arm is slightly less deep than the bearing B is thick, so that the outer race of bearing B is slightly above the upper surface of frame 29.

A generally rectangular cap 33 is mounted over the upper end of shaft 27 beneath thumb knob 31. Such cap 33 seats on the upper end of frame 29, and is held in position by a screw 34 (FIG. 2) that extends through it and through a protuberant portion of the upper frame arm. The cap 33, being pressed into place by screw 34, captures the outer bearing race so that the shaft 27 is held in longitudinally-fixed rotatable condition.

The cap 33 presses only against the outer race of ball bearing B. The inner race of the ball bearing is pressed onto the neckeddown upper portion of the shaft, and bears against boss 32. Thus, the bearing B serves as a ball-thrust bearing so that the shaft will not move longitudinally relative to frame 29 but is readily rotatable in such frame.

It is to be noted that pivoting of the frame 29, toward the wheel, is limited solely by tooth contact.

The locations of the shafts 19,20 are such that when frame 29 is pivoted toward worm-and-ratchet wheel 21, the worm teeth 28 and worm wheel teeth 26 are meshed with each other. Spring means are provided to pivot frame 29 toward this position. Referring to FIG. 2, a bent flat spring 36 is disposed between frame 29 and the rear wall 13, one end of the spring being in the corner between bottom plate 12 and such rear wall, the other end of the spring being in a notch provided on the rear side of the frame 29. The spring 36 is a weak spring, being only of sufficient strength to cause the teeth to be in light engagement with each other, this relationship reducing wear when the wheel 21 is—in pawl-and-ratchet manner—spun while the teeth 28 are engaged therewith.

Figure 3:
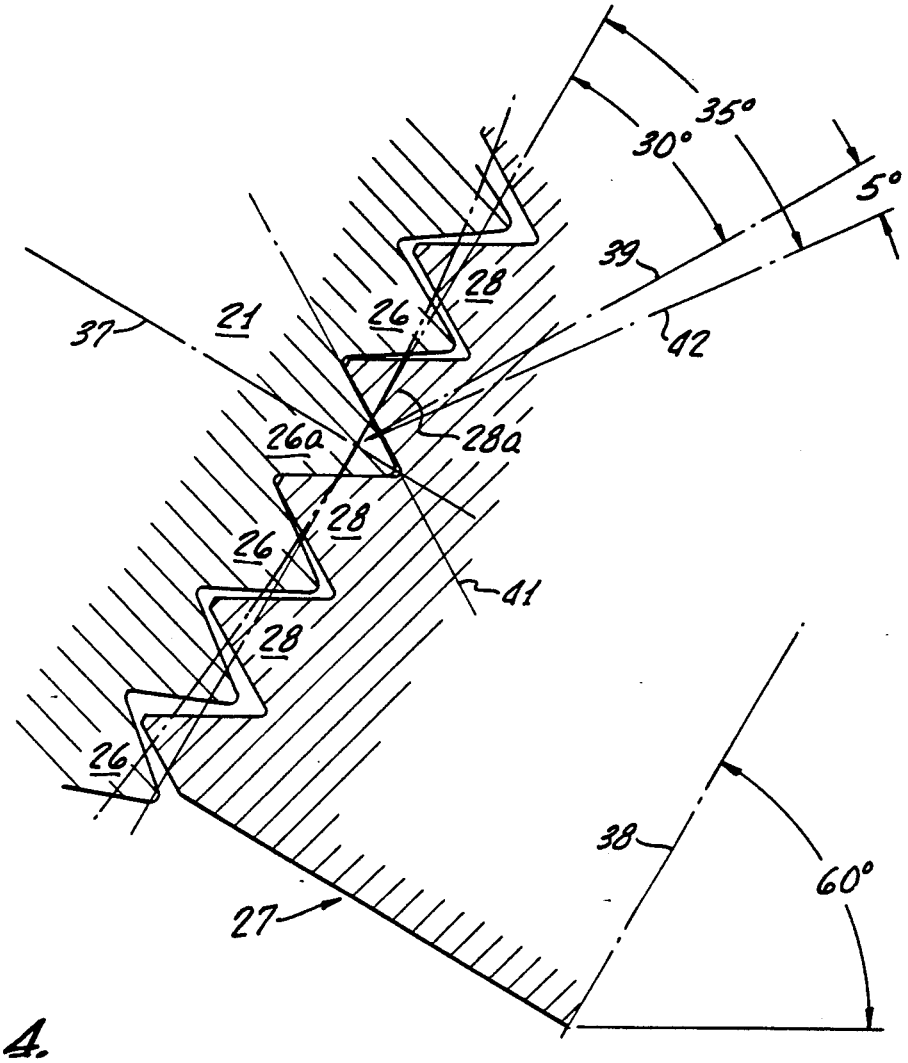
FIG. 3 is a greatly enlarged schematic view illustrating preferred relationships between contacting portions of a worm and worm wheel, which relationships cause the worm to be locked with the worm wheel by the tension in the string.

Referring next to FIG. 3, there is shown in greatly enlarged form the region where teeth 26 and 28 engage each other. As there shown, each of the standard screw teeth 26,28 is triangular in section. The relationships are such that one of teeth of shaft 27 is in substantially line contact with one of the teeth of wheel 21, these teeth being **28*a* and 26*a*, respectively. Adjacent teeth are in lesser contact or not in contact, due to the curvature of wheel 21**.

In the specific example of the preferred relationship, the crest of tooth **26*a* at the region of engagement is along a line 37 which is at a 30 degree angle to a horizontal plane containing the center of shaft 19. The center line of shaft 27, which center line is indicated by line 38**, is (in the preferred geometry) at a 60 degree angle to the horizontal.

A hypothetical line that is perpendicular to the line of contact between teeth **26*a*,28*a* is shown at 39, the line of contact being indicated at 41. The center line of shaft 20 for frame 29 is along a line 42 that is at an angle of 5 degrees to line 39, and is directly below such line 39 except at the point where both lines 39,42 engage tooth 26*a***.

The preferred distance between the center of shaft 20 and the surface of tooth **26*a*, along line 42, is 0.986 inches. Such preferred distance relates to the above-described specific example in which the diameter of wheel 21** is 1.62 inches.

With the described construction, there is a self-gripping or self-energizing relationship whereby the teeth 26,28 remain meshed despite the high compression created by the tension of string 23 when the string is tuned to playing pitch. The meshed relationship between the teeth at this time is not related, in any substantial amount, to the pressure exerted by spring 36, being instead the result of the geometry and other relationships. At this time, the thumb knob 31 may be rotated any desired number of turns, in either direction, in order to achieve fine tuning of the string 23.

In addition to the described worm-gear action by which any amount of fine tuning may be achieved, the mechanism operates also as a pawl-and-ratchet mechanism. Thus, wheel 21 may be rotated clockwise as viewed in FIG. 2 by manually directly engaging the wheel 21 and forcing the upper portion thereof away from the neck of the instrument. As the wheel 21 turns, the frame 29 pivots slight amounts back and forth so that successive ones of the teeth 26 are in line contact with tooth **28*a* (FIG. 3). Because the spring 36** is light, as above described, this ratcheting action does not cause substantial wear on the teeth.

It is to be noted that the upper sides of teeth 26 are engaged by worm teeth 28 when the latter teeth are holding the teeth 26 (and thus preventing rotation of wheel 21 despite the string tension). Conversely, the lower sides of teeth 26 are engaged when the wheel 21 rotates clockwise in ratchet manner. Accordingly, wear caused by ratcheting does not adversely affect tooth locking.

The described ratcheting action normally occurs during stringing of the instrument, as described below, and greatly increases the speed of stringing as compared to what would be the case if there were no ratcheting and the only turning of wheel 21 were caused by rotation of the worm shaft 27.

It is pointed out that the opposed worm wheel teeth 26, one set on each side of the string groove 22, effect automatic centering of the shaft 27 in such position that both sets of teeth engage shaft 27. Thus, any slop or play in the mount for shaft 27 is compensated for by the two rows of worm wheel teeth, by their bevelling and by their positioning.

The ratcheting action is very simple to perform, and requires very little manual force against wheel 21 when the associated string is not yet tight. At all times, the ratcheting is relatively quiet.

Because the amount of tuning that can be achieved by rotating the thumb knob is unlimited, each groove 22 may be quite deep and therefore may contain a substantial amount of string. It is not necessary to have a relatively shallow groove 22 so that a certain number of turns of the thumb knob 31 will achieve sufficient fine tuning.

Figure 4:
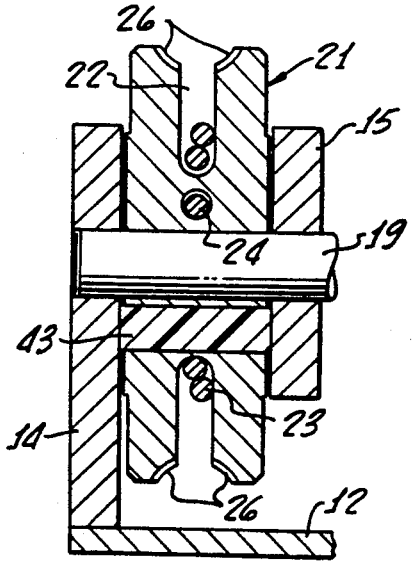
FIG. 4 is an enlarged fragmentary view showing the mechanism for preventing free spinning of the worm wheel, instead creating a drag that limits the rate of spinning.

Brake means are provided to prevent each wheel 21 from spinning freely, in response to string tension, when frame 29 is pivoted downwardly so as to disengage the teeth. This prevents backlash, etc. Such brake means comprises a cylinder 43 (FIG. 4) of a suitable synthetic resin, such cylinder extending through a bore that is formed in each worm wheel—parallel to the axis thereof—at a point inwardly of the bottom of string groove 22.

The length of the synthetic resin brake cylinder exceeds the spacing between the sides of wheel 21, and is sufficiently long that the cylinder ends rub on vertical surfaces of walls 14,15 or 15,15 as the wheel 21 turns. The cylinder length is calculated to cause such rubbing to be with a desired amount of friction.

As a specific example of the brake, let it be assumed that the distance between opposed walls 14,15 or 15,15 is 0.500 inch, and that the wheel 21 is 0.475 of an inch in thickness. The preferred length of the brake cylinder 43 is then 0.510 inch. The preferred material for the brake cylinder is polyurethane.

In accordance with another aspect of the invention, accidental pivoting of the frame 29 is prevented while still permitting fine tuning to occur, at all times, by merely rotating the shaft 27. For example, it would not be desirable for the string 23 to release in response to accidental bumping of thumb knob 31, by the guitarist, so as to disengage the teeth and permit wheel 21 to spin.

Figure 5:
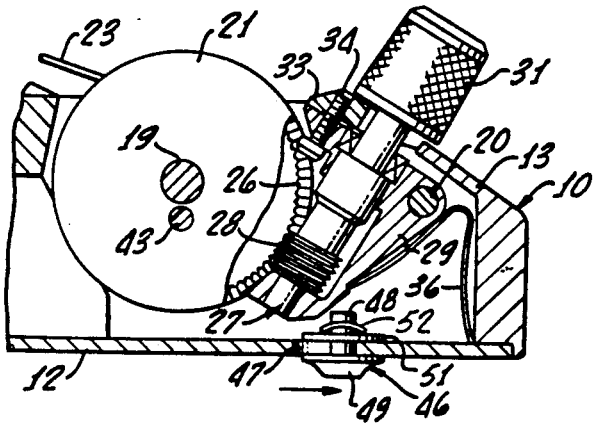
FIG. 5 is a view corresponding generally to the right side of FIG. 2, the parts being shown in release positions.

A locking element 46 is mounted in bottom plate 12 in such manner as to slide in a direction longitudinal to the guitar strings, between a release position and a position which prevents more than a slight amount of downward pivoting of frame 29. Referring to FIGS. 2 and 5, a longitudinal slot 47 is formed in bottom plate 12 beneath each frame 29. Extended upwardly through the slot 47 is the shank 48 of a button 49, the button being disposed beneath plate 12 and being so shaped as to tend to prevent unintentional manual shifting thereof. At the upper side of bottom plate 12, there is a spring washer 51 held in position by a spring clip 52. The washer 51 creates friction drag relative to the upper surface of the bottom plate. Thus, again, unintentional shifting of the locking element 46 is very unlikely.

When the locking element 46 is at its forward or inner position, which is the maximum forward (left) position permitted by slot 47 the front wall of which acts as a stop, the upper horizontal surface of shank 48 is beneath a horizontal corner 53 of frame 29 and is only a few thousandth of an inch from such corner. Thus, there is no actual contact between the locking element and the frame 29, so that there is no interference with rotation of the worm shaft 27 by thumb knob 31. On the other hand, if the thumb knob is accidentally engaged in such direction as to tend to pivot the frame 29 and associated worm shaft downwardly, the upper end of shank 48 is substantially immediately engaged by corner 53. This occurs before the teeth 26,28 cease being meshed with each other. It follows that accidental engagement of the thumb knob 31 does not disengage the teeth and does not permit release of the wheel 21. FIG. 2 shows the locking positions, while FIG. 5 shows release positions permitting ratcheting.

The Bridge and Intonation Mechanism

Referring to FIGS. 1, 2, 6 and 7, the inner or forward portion of the casting which forms the main part of base 10 has, in addition to forward wall 16, sidewalls **14*a* that form extension of sidewalls 14 but have much smaller vertical dimensions than those of the rear sidewall portions. The casting further includes a thick transverse wall 56 that is perpendicular to walls 14*a*. The wall 56 separates the present mechanism into that portion which contains wheels 21, etc., and that portion which contains adjustable saddle elements 57 (FIG. 6). As in the case of wheels 21 and their associated elements, saddle elements 57 are identical to each other. There is one saddle element directly in line with one wheel 21**, etc.

A groove 58, parallel to the strings, is formed in the top of transverse wall 56 for each saddle element 57. Each groove 58 is adjacent one side of its associated saddle. Thus, one end of each groove is relatively adjacent a vertical surface of a wall 14 or 15, while the other end of each groove is relatively adjacent a divider wall 59 or a sidewall **14*a*** formed in the inner or forward portion of the casting.

Transverse wall 56, divider walls 59, and other portions of the casting define four rectangular chambers or recesses 60 (Figs. 6 and 7). Each recess 60 holds in slidable relationship an elongate tilt block 61. Each such tilt block slides along the bottom wall 62 of the inner or forward portion of the casting, being held—by walls 59—in parallel relationship to the longitudinal axis of the present apparatus and of the guitar. Front and back end walls 63,64 of each chamber 60 serve as stops that limit the travel of tilt blocks 61 longitudinally of the apparatus.

There is formed in the bottom wall 62, centrally in each chamber or recess 60, a longitudinal slot 66. The wall regions W adjacent the side of each slot 66 are bevelled on their undersides, so that the lower surfaces of bottom wall 62 at regions adjacent each side of each slot 66 incline outwardly.

A fulcrum screw 67 is extended upwardly through each slot 66 and is threaded into the bottom-center portion of tilt block 61. The head 68 of each fulcrum screw 67 has a frustoconical upper surface the angle of which substantially corresponds to that of the undersurfaces W of bottom wall 62 adjacent slot 66.

Each fulcrum screw 67 is not used to tighten or clamp the tilt block 61 in any position. Instead, screw 67 is only threaded upwardly into tilt block 61 a distance such that the upper surface of the screw head 68 is not in engagement with bottom wall 62—at the bevelled undersurfaces W thereof—but is close to such bevelled undersurfaces. Preferably, screw 67 is threaded into the tilt block 61 to the desired extent and is then held against rotation as by a suitable epoxy or other adhesive provided on the screw threads.

The result is that tilt block 61 can easily slide forwardly and rearwardly to the extent permitted by walls 63,64, and can also tilt to the extent permitted by screw 67 and its head 68, but cannot rotate about a vertical axis since the divider walls 59 prevent such rotation.

A saddle top 70, preferably a metal casting, is mounted over each tilt block 61. Each saddle top has a relatively thick upper wall 71 that extends over the tilt block 61 and also extends toward the associated wheel 21. The upper surface of each saddle top 70 does not engage the associated guitar string 23 except at a region of saddle top 70 remote from the associated wheel 21. Such region is centrally notched or longitudinally grooved at 72 to seat the string 23.

Each saddle top has a rearwardly-extending portion that is always over the transverse wall 56 and the grooves 58 in such transverse wall. Such rearwardly-extending portion is always over such wall 56 and grooves 58 because of the positioning of stop walls 63,64, the selected length of tilt block 61, and the positioning and length of slot 66.

An alignment and locking foot 75 is provided on the underside of saddle top 70 at the rear end thereof, relatively adjacent the associated wheel 21, and is seated snugly in a groove 58. Thus, as the saddle element 57 comprised of tilt block 61 and saddle top 70 moves longitudinally of the guitar, locking foot 75 remains in an associated groove 58; this keeps the saddle top 70 in precise alignment parallel to the axis of the instrument.

The saddle top 70 also has a skirt 76, for aesthetic reasons, which fits downwardly around upper portions of tilt block 61 in relatively loose relationship.

Two parallel slots 77 are formed in upper wall 71 of saddle top 70, on opposite sides of string 23 at the forward or inner end of the saddle. Each slot 77 extends parallel to the axis of the instrument, and has a narrow upper portion 78 and a less narrow lower portion 79. Upper portion 78 extends upwardly to the top surface of the upper wall 71, while the less-narrow lower portion 79 extends downwardly to the lower surface of such upper wall.

Combination saddle-height-adjustment and fulcrum screws 81 are threaded vertically downwardly into the forward (inner) portion of each tilt block 61. Each such screw 81 has a cylindrical knurled head 82 the diameter of which is sufficiently small that the head fits rotatably in the lower portion 79 of slot 77 but sufficiently large that the head does not fit in the narrow upper slot portion 78. Thus, as illustrated in FIG. 7, the upper surface of each head 82 seats on the undersides of the shoulders 83 where slot portions 78,79 meet each other.

Each screw head 82 has an Allen opening formed centrally in the upper side thereof, adapted to receive a wrench that will extend downwardly through the narrow upper portion 78 of slot 77. When a wrench is thus extended into a screw head 82 and rotated, the inner end of each saddle top 70 rises or lowers in accordance with the direction of rotation, thus determining the height of the forward portion of the saddle mechanism so as to adjust string height.

A tilt screw, numbered 84, is threaded downwardly into tilt block 61 at the rear end thereof, on the opposite side of fulcrum screw 67 from the screws 81. The screw 84 is located on one side of the string 23, preferably the same side of such string as that on which the alignment and locking foot 75 (and its associated groove 58) is located.

The tilt screw 84 has a head 85 (with an Allen opening therein) that fits rotatably in a relatively large-diameter upper part 86 of an aperture in upper wall 71, the head being so large that it will not extend downwardly into a lower part 87 of such aperture. Thus, the head seats on a shoulder 88 at the junction between the upper and lower parts 86,87 of the aperture. The aperture is sufficiently large to permit saddle top 70 to tilt relative to screw 84.

Referring to FIG. 6, a hypothetical triangle T is drawn between the centers of elements 75 and 82. The center of head 85 must fall within this triangle (as viewed from above) in order to exert proper force on all three contact points. In addition, it is possible to obtain a slight side to side string spacing adjustment. When one height adjusting screw is adjusted higher than the other the saddle is tilted which slightly changes string spacing. The side to side and height up and down adjustments require the foot to be a "ball protrusion"—a "fits all positions concept".

SUMMARY OF OPERATION AND METHOD

To string any of the strings 23 onto the guitar, and bring it up to proper pitch, and have the correct intonation, the musician first mounts the string and extends it over a saddle 57, namely in the groove 72 (FIG. 6). The height of the string 23 above the guitar neck is then adjusted. For a particular setting of the truss rod in the guitar neck, string height adjustment is effected by rotating screws 81 so as to raise or lower their heads 82. The upper surfaces of the screw heads 82 bear on shoulders 83 as above stated, and either lift or lower the inner (forward) end of the upper wall 71 of the saddle top.

Then, to lock the saddle 57 in any desired longitudinally adjusted position permitted by slot 66 and end walls 63,64, the musician rotates the tilt screw 84 in such direction as to thread (tighten) it into the tilt block 61 until it is reasonably tight in such block. There is no requirement for large force when the tilt screw 84 is turned, because a very effective locking action then occurs as the result of the compound lever action next described.

The above-described tightening of tilt screw 84 lifts upwardly the outer or rearward end of tilt block 61, thus causing a gap G to be present between the bottom surface of the tilt block and the top surface of bottom wall 62, as shown in FIG. 7. The amount of upward tilting of block 61 is limited by the head 68 of fulcrum screw 67, which head engages the bevelled surfaces of the underside of wall 62. The tilt block and associated screws then operate as a first-class lever system, with upward force being applied by screw 84, with head 68 of screw 67 acting (together with the associated wall region) as a fulcrum, and with the forward or inner and lower edge E of tilt block 61 engaging bottom wall 62 which provides resistance.

Stated otherwise, tightening of screw 84, to lift the rear end of tilt block 61 and create the gap G, causes downward pressing of edge E of the forward end of the tilt block. Edge E presses downwardly on the upper surface of bottom wall 62, and this is one important factor creating high friction between the saddle 57 and the casting so as to prevent longitudinal shifting of the saddle.

The same tightening of tilt screw 84 creates a third-class lever action relative to upper wall 71 of the saddle, such lever action pressing the alignment and locking foot 75 downwardly into groove 58 with high friction. This high-friction relationship between foot 75 and the surface of casting groove 58, in combination with the friction present at edge E, effectively locks the saddle 57 against shifting even though (as stated above) the force exerted by screw 84 need not be large.

The indicated third-class lever action is one by which the upper surfaces of the heads 82 of screws 81 act as fulcrums, the screw 84 creates downward force on shoulder 88 on upper wall 71, and resistance is presented by the casting to the foot 75.

In sum, there is a compound lever action by which the screw 84 pivots both the tilt block 61 and the upper wall 71 to create effective downward pressing at foot 75 and at edge E. In addition, there is upward pressing between the upper surface of screw head 68 and the bevelled surfaces of bottom wall 62. All of these are pressure points creating friction and thus locking.

The musician then tunes the string and thereafter determines whether or not the intonation is correct. If intonation is not correct, so that longitudinal adjustment of the saddle 57 is desired, and/or if the musician desires to change string height, he or she detunes the string 23 and then loosens the screw 84. He or she then makes a desired saddle adjustment by shifting the saddle longitudinally of string 23, and then again tightens screw 84 so as to lock the mechanism in the different position. The string is then brought up to playing tension and a check is made to see whether the intonation is correct. The method is repeated until the intonation is correct.

It is an extremely simple matter to tune and detune each string 23 repeatedly, so as to adjust intonation, because the combination worm-and-pawl element 27 may be rotated in any direction through any number of revolutions by means of the thumb knob 31. Such rotation turns the worm-and-ratchet wheel 21 to either tune or detune the string 23, as desired.

At all times except when it is desired to change a string, etc., the worm teeth (screw thread) 28 stay in meshed relationship with the worm wheel teeth 26, because of the self-locking or self-energizing relationship described relative to FIG. 3. As stated above, the spring 36 (FIG. 2) is preferably a very light one, which operates merely to maintain the teeth in touching relationship during ratcheting actions—being unimportant when there is tension on the string 23.

To change a string, it is first detuned. Then, the button 49 of locking element 46 is manually engaged and shifted rearwardly, so that the horizontal corner 53 of frame 29 is no longer in proximity to the upper end of shank 48 of the locking element. Then, the musician presses forwardly on thumb knob 31 to tilt frame 29 downwardly about shaft 20, thus disengaging the teeth 26,28. Wheel 21 then tends to spin because of the tension of string 23, but rapid spinning and backlashing are prevented by the described brake cylinder 43 (FIG. 2).

After one string has been removed, a new one is mounted by an operation including threading the end of the string through the string bore 24 and then manually bending the string at a point closely adjacent the bottom of string groove 22 (FIG. 2), so that the string is in the position shown in FIG. 2. During this bending operation, the musician manually applies tension to the region of the string remote from wheel 21. As soon as bending has been achieved, the musician uses his or her thumb to manually engage and directly rotate wheel 21 clockwise as viewed in FIG. 2, this creating a ratcheting action between teeth 26,28. At all times, the weak spring 36 tends to maintain the teeth engaged during the pawl-and-ratchet operation. As soon as this direct manual rotation of wheel 21 is stopped, the ratcheting action locks the wheel so that the tension built up in string 23 does not lessen at all.

After the manual ratcheting of wheel 21 has brought the string 23 up to a desired degree of tension (there being no need for large force on wheel 21 by direct manual rotation of such wheel), the thumb knob 31 is turned in a direction to increase string tension. Thus, with high mechanical advantage, the string 23 is brought up to playing pitch. Then, to prevent accidental disengagement of the teeth from each other, the locking mechanism 46 is operated to prevent substantial pivoting of frame 29 while still permitting fine tuning to occur at any time by merely rotating the thumb knob.

The foregoing detailed description is to be clearly understood as given by way of illustration and example only, the spirit and scope of this invention being limited solely by the appended claims.

What is claimed is:

1. An adjustable saddle mechanism for a guitar, said mechanism comprising (a) a base having an elongate slot therein, (b) a tilt element slidably mounted on said base above said slot, (c) a fulcrum element extended through said slot and connected to said tilt element, said fulcrum element having a portion at the lower end thereof that is so large as to prevent passage of said portion through said slot, (d) means to support a guitar string above said tilt element, and (e) means to pivot said tilt element in such manner as to create a gap between said base and the underside of said tilt element, in such manner as to cause said portion of said fulcrum element to engage the underside of said base adjacent said slot, and in such manner as to cause a portion of said tilt element to forcibly engage said base in high-friction contact therewith, thereby preventing sliding of said saddle mechanism along said base.

2. The invention as claimed in claim 1, in which said tilt element is so shaped that said part thereof that forcibly engages said base is an edge in line contact with said base.

3. The invention as claimed in claim 1, in which said saddle mechanism further comprises means to adjust the height of said string.

4. The invention as claimed in claim 1, in which said elements are arranged as a first-class lever, said fulcrum element being disposed between said base-contacting portion and said means to pivot said tilt element.

5. An adjustable saddle mechanism for a guitar, which comprises:

(a) a base, (b) upper and lower saddle elements connected to each other and slidably mounted on said base, said upper saddle element being adapted to support a guitar string, and (c) compound lever means to lock said saddle elements in any one of an infinite number of positions along said base whereby to adjust the intonation of said string.

6. The invention as claimed in claim 5, in which said compound lever means includes means to create a first pressure point between said upper said saddle element and said base and to create a second pressure point between said lower saddle element and said base, said first and second pressure points exerting sufficient friction relative to said base to prevent said saddle element from sliding longitudinally.

7. The invention as claimed in claim 6, in which said base has an alignment groove in the upper side thereof, and in which said means to create a first pressure point includes a foot on said upper saddle element and disposed in said groove, said foot and said groove cooperating to maintain precise alignment of said saddle element.

8. The invention as claimed in claim 5, in which said base has a longitudinal slot therein, and in which said compound lever system includes a fulcrum element extended through said slot and connected to said lower saddle element, said fulcrum element having a portion beneath said slot sufficiently large that it will not go through said slot.

9. The invention as claimed in claim 5, in which said compound lever means includes height-adjustment screws extending upwardly from said lower saddle element into said upper saddle element to support the latter, said screws being adjustable to raise and lower said upper saddle element at regions generally beneath the point where said string seats on said upper saddle element.

10. The invention as claimed in claim 5, in which said lower saddle element is a tilt element mounted slidably on said base, in which said base has a longitudinal slot therein extending substantially parallel to said string, in which a fulcrum element is extended through said slot and connected to a central region of said lower saddle element, said fulcrum element having a lower portion excessively large to pass through said slot, in which height adjustment screws are extended downwardly into said lower saddle element, the upper ends of said screws supporting said upper saddle element at one end thereof, in which the other end of said upper saddle element is supported directly on said base, and in which a tilt screw is threaded downwardly into said tilt element through a central region of said upper saddle element, said tilt screw being adapted when tightened to tilt said lower saddle element until one edge thereof is in forcible engagement with said base at a region adjacent said slot, and is also adapted when tightened to pivot said upper saddle element about said height adjustment screws to bias said other end of said upper saddle element against said base.

11. The invention as claimed in claim 10, in which said fulcrum element is between said height adjustment screws and said tilt screw, and in which said tilt screw is between said fulcrum element and said other end of said upper saddle element.

12. The invention as claimed in claim 10, in which said height adjustment screws have heads that are disposed in the lower regions of slots in said upper saddle element, said lower regions being sufficiently large to rotatably receive the heads of said height adjustment screws, in which said slots have upper portions that are excessively narrow to receive said heads but are sufficiently wide to receive wrench means to turn said height adjustment screws, whereby said heads seat on shoulders between said upper and lower portions, in which said tilt screw is extended downwardly through an aperture in said upper saddle element and threadedly associated with said lower saddle element, said tilt screw having a head at the upper end thereof that is rotatably mounted in a relatively large aperture portion at the upper region of said upper saddle element, the shank of said tilt screw extending downwardly through a relatively small aperture region of said upper saddle element, the underside of said head seating on a shoulder between said upper and lower aperture portions.

* * * * *